US005933694A

United States Patent [19]

Yamashita et al.

[11] Patent Number: 5,933,694

[45] Date of Patent: Aug. 3, 1999

[54] IMAGE FORMING METHOD AND IMAGE FORMING APPARATUS FOR SIMULTANEOUSLY TRANSFER-FIXING A TONER IMAGE WITHOUT CREATING CREASES

[75] Inventors: Takayuki Yamashita; Tsukasa Matsuda; Yuichi Fukuda; Tetsuo Yamada; Yoshihisa Kitano; Kazuhiko Arai, all of Nakai-Machi, Japan

[73] Assignee: Fuji Xerox, Co., Ltd., Tokyo, Japan

[21] Appl. No.: 09/066,535

[22] Filed: Apr. 27, 1998

[30] Foreign Application Priority Data

May 7, 1997 [JP] Japan ..... 9-116844

[51] Int. Cl.[6] ..... G03G 15/20

[52] U.S. Cl. ..... 399/322; 399/307; 399/406; 430/124; 430/126

[58] Field of Search ..... 399/307, 302, 399/308, 322, 328, 341, 406; 271/188; 430/124, 126; 219/216

[56] References Cited

U.S. PATENT DOCUMENTS

| | | | |
|---|---|---|---|
| 2,990,278 | 6/1961 | Carlson | 430/124 |
| 4,015,027 | 3/1977 | Buchan et al. | 430/124 |
| 4,430,412 | 2/1984 | Miwa et al. | 430/126 |
| 4,455,079 | 6/1984 | Miwa et al. | 399/308 |
| 5,159,394 | 10/1992 | Jinzai | 399/322 X |
| 5,319,429 | 6/1994 | Fukuchi et al. | 219/216 X |
| 5,689,786 | 11/1997 | Tokunaga et al. | 399/307 |
| 5,742,888 | 4/1998 | Fuchiwaki et al. | 399/308 |

FOREIGN PATENT DOCUMENTS

| | | |
|---|---|---|
| A-5-19642 | 1/1993 | Japan . |
| A-5-107950 | 4/1993 | Japan . |
| A-5-249798 | 9/1993 | Japan . |

*Primary Examiner*—Arthur T. Grimley
*Assistant Examiner*—Sophia S. Chen
*Attorney, Agent, or Firm*—Oliff & Berridge, PLC

[57] ABSTRACT

An image forming apparatus heats and presses a toner image retaining medium, with a toner image being formed thereon, and a sheet of print paper in face-contact with each other so that the toner image is transferred and simultaneously fixed onto the print paper, and rectifies the curling of the face-contact medium and paper during the heat-pressing process, thereby attaining a high print quality without creases on the paper which would otherwise emerge due to the heat-pressing process.

11 Claims, 13 Drawing Sheets

IMAGE FORMING METHOD AND IMAGE FORMING APPARATUS FOR SIMULTANEOUSLY TRANSFER-FIXING A TONER IMAGE WITHOUT CREATING CREASES

BACKGROUND OF THE INVENTION

1. Field of the Invention

The present invention relates to an image forming method and an image forming apparatus, such as a printer and copy machine, based on the simultaneous transfer-fix scheme, in which a toner image formed on a toner image retaining medium is transferred and at the same time fixed onto a recording medium.

2. Description of the Prior Art

The conventional widely-used image forming method is designed to form a static latent image on a photosensitive member, develop the latent image with dry toner, transfer the toner image onto a recording medium, i.e., print paper electrostatically, and fix the toner image on the print paper. This image forming method, however, has a problem of the deterioration of print quality due to the rough surface of the print paper. Namely, the print paper does not come in precise contact with the photosensitive member and the resulting unevenness of gap causes the disturbance of transfer electric field and the emergence of Coulomb's repulsive force among toner particles.

In order to cope with this problem, there have been invented an image forming method for producing a color copy, in which toner images of multiple colors are transferred by being superimposed onto an intermediate transfer medium, the multi-color toner images are fused on the intermediate transfer medium, and the molten multi-color toner image is transferred and at the same time fixed on a recording medium, and an image forming method in which a toner image formed on a photosensitive member having a shape of endless belt is fused, and it is transferred and fixed on a recording medium. These methods do not base the transfer of toner image onto the recording medium on the electrostatic scheme, and accordingly the above-mentioned deterioration of print quality is unlikely to arise.

In regard to the image forming method of this sort, there have been proposed techniques for improving the transfer of a toner image from a toner image retaining medium, such as an intermediate transfer medium or a photosensitive member, onto a recording medium, in which the toner image retaining medium and recording medium in tight face-contact with each other are heated and pressed, these face-contact members are cooled so that toner solidifies, and the recording medium, with the toner image being fixed on it, is separated from the toner image retaining medium, as described in U.S. Pat. No. 2, 990,278, and Japanese Published Unexamined Patent Application Nos. Hei 5-19642,5-107950 and 5-249798. This method is designed to separate toner from the toner image retaining medium after the cohesion among toner particles exceeds the adhesion between toner and the toner image retaining medium, and accordingly it can prevent the occurrence of so-called "off-set" in which part of toner remains on the toner image retaining medium. Thus, the method enables the oil-less process and improves the color balance owing to the high toner transfer efficiency. Moreover, based on the toner solidification along the surface of the toner image retaining medium, high-quality prints with the well polishing and transparent features of toner can be produced by using a toner image retaining medium having a smooth surface.

FIG. 15 shows schematically the structure of the image forming apparatus which adopts the simultaneous transfer-fix scheme.

This image forming apparatus has a train of four photosensitive members 1-1, 1-2, 1-3, and 1-4 of the roller type. These photosensitive members are charged uniformly by respective chargers 10-1, 10-2, 10-3, and 10-4, while being turned in the direction indicated by the arrow, and static latent images are formed on the photosensitive members based on the scanning of light beams, which are modulated by the image density signals, from a light beam scanning device 20. The static latent images are developed with toners of black, yellow, magenta, and cyanine by respective developers 11-1, 11-2, 11-3, and 11-4, so that toner images of these colors are formed on the respective photosensitive members.

The apparatus further includes an intermediate transfer medium 50 having a shape of endless belt which circulatively moves along the four photosensitive members 1-1, 1-2, 1-3, and 1-4. The intermediate transfer belt 50 is looped to run around rollers 5-1, 5-2, 5-3, and 5-4 and a heat roller 2, with a certain magnitude of tension being applied thereto by the tension roller 5-3, and move along the respective photosensitive members 1-1, 1-2, 1-3, and 1-4, so that the multi-color toner images formed on the photosensitive members are transferred by being sequentially superimposed on the transfer belt 50 by the operation of respective transfer devices 50-1, 50-2, 50-3, and 50-4.

When the multi-color toner image reaches the heating section A where the intermediate transfer belt 50 runs around the heat roller 2, it is fused by the heat generated by a heat source 120 which is installed inside the heat roller 2. The molten toner image further goes and reaches the transfer-fixing section B. A sheet of print paper 60 is taken out of a paper tray 6, and fed to the transfer-fixing section B by way of a paper feed roller 6-1, guide roller 6-2, and register roller 6-3 by being timed so that the toner image on the intermediate transfer belt 50 comes to the transfer-fixing section B coincidently.

A press roller 3 is disposed at the transfer-fixing section B to confront the heat roller 2, and it operates by being timed to the feeding of the print paper 60 from the paper tray 6 thereby to press the paper to the heat roller 2. Accordingly, in the transfer-fixing section B, the intermediate transfer belt 50, with the toner image being formed on it, and the print paper 60 in face-contact with each other are heated and pressed between the heat roller 2 and the press roller 3. The face-contact print paper 60 and intermediate transfer belt 50, with the toner image being caught between them, go out of the gap between the heat roller 2 and the press roller 3, and reach a cooling device 4, by which toner is cooled to solidify. The paper 60 and belt 50 reach a separating roller 5-4 having a small diameter, on which the print paper 60 having the toner image separates based on its own stiffness from the intermediate transfer belt 50. The separated print paper 60, with the toner image being fixed on it, is carried by a paper carrying device 7 and delivered to the outside of the image forming apparatus.

However, image formation by the foregoing image forming apparatus occasionally incurs an inappropriate phenomenon. Namely, on the print paper 60 after the heat-pressing operation, there emerge numerous creases 61 in the direction perpendicular to the paper carrying direction as shown in FIG. 16, causing toner to peel off the intermediate transfer belt 50 before it is cooled to solidify. This phenomenon not only creates creases on the print paper 60, but deteriorates the print quality considerably. FIG. 17 shows the cross section along the paper carrying direction of the intermediate transfer belt, toner and print paper in this situation. Specifically, at the creasing portion of the print paper 60, toner 100 peels off the intermediate transfer belt 50 before it is cooled to solidify. On this account, toner 100 does not solidify smoothly along the surface of the intermediate transfer belt 50 in this portion, lowering the polish and resulting in a degraded print quality. The above-mentioned impropriety arising during the transfer-fixing process of a toner image on the print paper by way of the intermediate transfer belt occurs similarly in the case of transferring and fixing a toner image directly from a photosensitive member of the belt type, for example, to the print paper.

SUMMARY OF THE INVENTION

The present invention is intended to overcome the foregoing prior art problem, and its prime object is to provide an image forming method based on the simultaneous transfer-fix scheme in which a toner image on a toner image retaining medium is transferred and at the same time fixed onto a recording medium, thereby attaining a high print quality without the emergence of uneven polish, and provide an image forming apparatus based on this method.

In order to achieve the above objective, a first image forming method based on this invention comprises the operational steps of: forming a toner image on a toner image retaining medium of the sheet type; bringing a recording medium of the sheet type in face-contact with the toner image retaining medium so that the toner image is caught therebetween; heating and pressing the toner image retaining medium and recording medium in face-contact with each other, with the toner image being caught therebetween; and relieving of the heat and press and thereafter cooling the toner image retaining medium and recording medium in face-contact with each other, with the toner image being caught therebetween, so that the toner image is fixed on the recording medium, wherein the toner image retaining medium, with the toner image being retained thereon, and the recording medium in face-contact with each other are heated and pressed in a curly state, and the curling direction of the toner image retaining medium and recording medium in face-contact with each other is reversed at least once before the end of the step of heat-pressing.

In order to achieve the above objective, a second image forming method based on this invention comprises the operational steps of: forming a toner image on a toner image retaining medium of the sheet type; bringing a recording medium of the sheet type in face-contact with the toner image retaining medium so that the toner image is caught therebetween; heating and pressing the toner image retaining medium and recording medium in face-contact with each other, with the toner image being caught therebetween; and relieving of the heat and press and thereafter cooling the toner image retaining medium and recording medium in face-contact with each other, with the toner image being caught therebetween, so that the toner image is fixed on the recording medium, wherein the toner image retaining medium, with the toner image being retained thereon, and the recording medium in face-contact with each other are heated and pressed while being kept in a flat state.

In order to achieve the above objective, a third image forming method based on this invention comprises the operational steps of: forming a toner image on a toner image retaining medium of the sheet type; bringing a recording medium of the sheet type in face-contact with the toner image retaining medium so that the toner image is caught therebetween; heating and pressing the toner image retaining medium and recording medium in face-contact with each other, with the toner image being caught therebetween; and relieving of the heat and press and thereafter cooling the toner image retaining medium and recording medium in face-contact with each other, with the toner image being caught therebetween, so that the toner image is fixed on the recording medium, wherein the toner image retaining medium, with the toner image being retained thereon, and the recording medium in face-contact with each other are heated and pressed in a curly state, and the toner image retaining medium and recording medium are kept in the curly state of the time of heat-pressing after the relief of the heat-pressing until toner which has been fused by the heat-pressing cools down below the fusing temperature.

In order to achieve the above objective, a fourth image forming method based on this invention comprises the operational steps of: forming a toner image on a toner image retaining medium of the sheet type; bringing a recording medium of the sheet type in face-contact with the toner image retaining medium so that the toner image is caught therebetween; heating and pressing the toner image retaining medium and recording medium in face-contact with each other, with the toner image being caught therebetween; and relieving of the heat and press and thereafter cooling the toner image retaining medium and recording medium in face-contact with each other, with the toner image being caught therebetween, so that the toner image is fixed on the recording medium, wherein the toner image retaining medium and recording medium in face-contact with each other are relieved of the external force, which forces the face-contact mediums to curl, simultaneously with the relief of the heat-pressing.

These first through fourth image forming methods of this invention have their operational step of cooling the toner image retaining medium and recording medium, with the toner image being caught therebetween, being based on either the scheme of forced cooling or the scheme of natural cooling.

In order to achieve the above objective, a first image forming apparatus for forming a fixed toner image on a recording medium based on this invention comprises: a toner image retaining medium of the sheet type which retains and brings a toner image formed thereon to a predetermined image transfer position; a toner image forming means which forms the toner image on the toner image retaining medium; a recording medium carrying means which supplies a recording medium of the sheet type by being timed so that the recording medium is brought in face-contact with the toner image retaining medium, with the toner image being caught therebetween; and a heat-pressing means which heats and presses the toner image retaining medium and recording medium in face-contact with each other, with the toner image being caught therebetween, at the image transfer position during the carriage in a curly state, and defines the carrying path of the toner image retaining medium and recording medium in face-contact with each other so that the curling direction of the toner image retaining medium and recording medium is reversed at least once after the toner image retaining medium and recording medium are brought in face-contact with each other and before the end of the heat-pressing operation.

In order to achieve the above objective, a second image forming apparatus for forming a fixed toner image on a recording medium based on this invention comprises: a toner image retaining medium of the sheet type which retains and brings a toner image formed thereon to a predetermined image transfer position; a toner image forming means which forms the toner image on the toner image retaining medium; a recording medium carrying means which supplies a recording medium of the sheet type to the image transfer position by being timed so that the recording medium is brought in face-contact with the toner image retaining medium, with the toner image being caught therebetween; and a heat-pressing means which heats and presses the toner image retaining medium and recording medium in face-contact with each other, with the toner image being caught therebetween, while defining the carrying path thereof so that the toner image retaining medium and recording medium in face-contact with each other remain in a flat state.

In order to achieve the above objective, a third image forming apparatus for forming a fixed toner image on a recording medium based on this invention comprises: a toner image retaining medium of the sheet type which retains and brings a toner image formed thereon to a predetermined image transfer position; a toner image forming means which forms the toner image on the toner image retaining medium; a recording medium carrying means which supplies a recording medium of the sheet type to the image transfer position by being timed so that the recording medium is brought in face-contact with the toner image retaining medium, with the toner image being caught therebetween; a heat-pressing means which heats and presses the toner image retaining medium and recording medium in face-contact with each other, with the toner image being caught therebetween, at the transfer position during the carriage in a curly state; and a carrying path defining means which defines the carrying path of the face-contact mediums so that the face-contact mediums remain in the curly state at the time of heat-pressing during the carriage after the relief of the heat-pressing by the heat-pressing means until toner which has been fused by the heat-pressing cools down below the fusing temperature.

In order to achieve the above objective, a fourth image forming apparatus for forming a fixed toner image on a recording medium based on this invention comprises: a toner image retaining medium of the sheet type which retains and brings a toner image formed thereon to a predetermined image transfer position; a toner image forming means which forms the toner image on the toner image retaining medium; a recording medium carrying means which supplies a recording medium of the sheet type by being timed so that the recording medium is brought in face-contact with the toner image retaining medium, with the toner image being caught therebetween; and a heat-pressing means which heats and presses the toner image retaining medium and recording medium in face-contact with each other, with the toner image being caught therebetween, at the image transfer position during the carriage in a curly state, and relieves the face-contact mediums of the external force, which forces the face-contact mediums to curl, simultaneously with the relief of the heat-pressing.

These first through fourth image forming apparatuses of this invention have their toner image forming means being based on either the scheme of forming a toner image directly on the toner image retaining medium or the scheme of forming a toner image temporarily on another medium and transferring the toner image on that medium to the toner image retaining medium.

DESCRIPTION OF THE PREFERRED EMBODIMENTS

Before entering into the explanation of the embodiments of this invention, the cause of creases emerging on the print paper at the transfer-fixing process will be explained.

Figure 15:
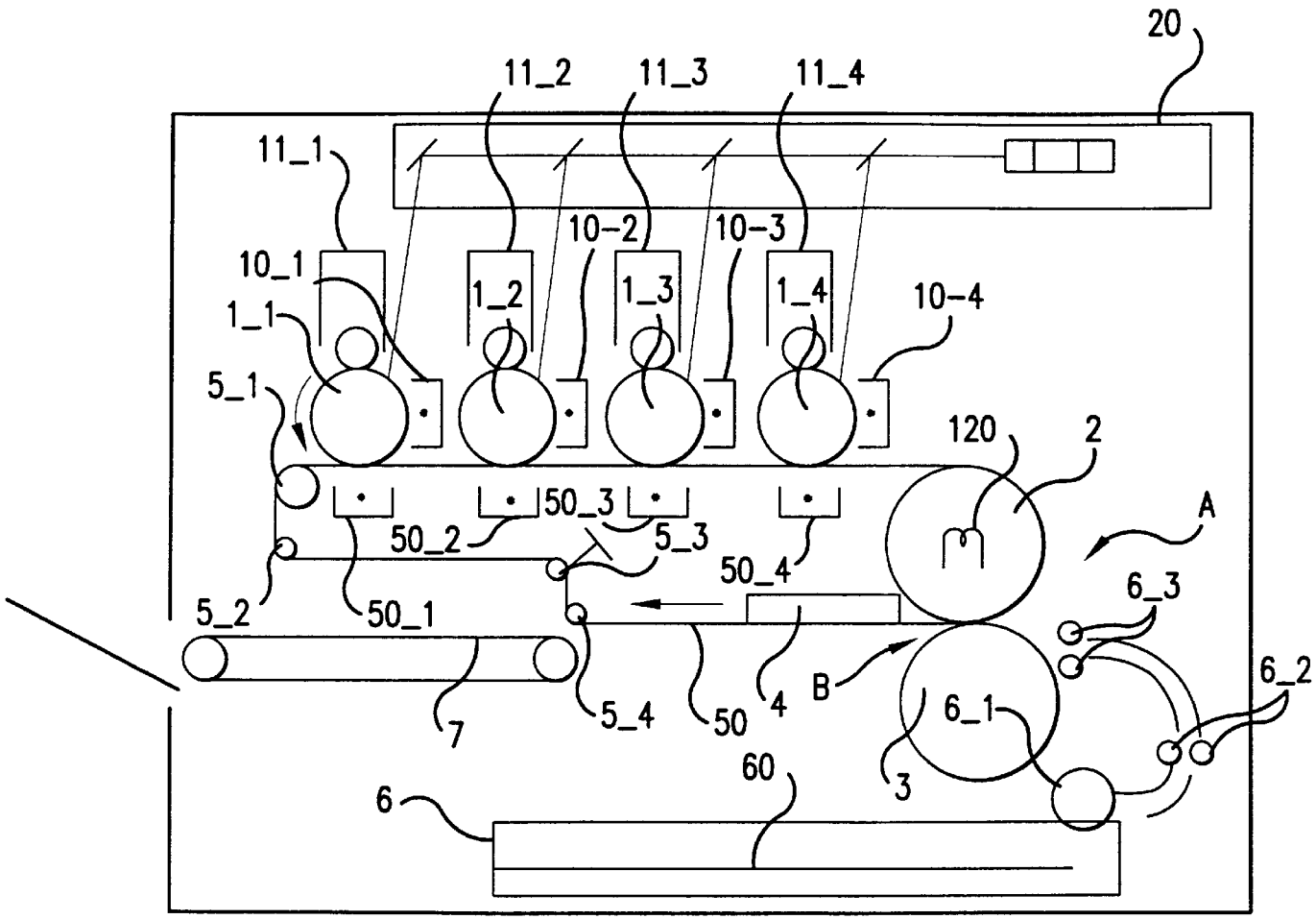
FIG. 15 (PRIOR ART)
FIG. 15 is a schematic diagram showing the conventional image forming apparatus.
Figure 16:
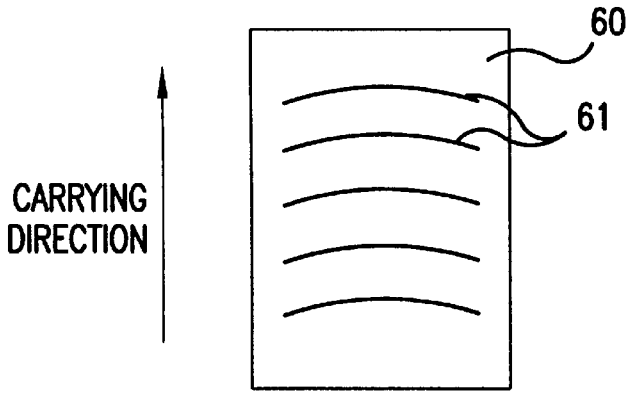
FIG.16 (PRIOR ART)
FIG. 16 is a diagram used to explain the problem of the conventional image forming apparatus.
Figure 17:
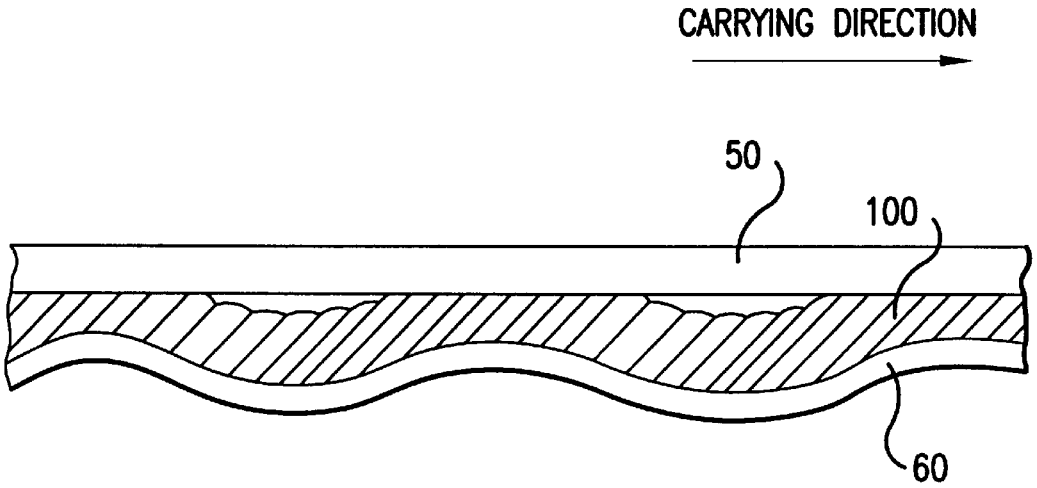
FIG.17 (PRIOR ART)
FIG. 17 is a cross-sectional diagram used to explain the problem of the conventional image forming apparatus.

In the image forming apparatus shown in FIG. 15, the transfer-fixing section B consists of the heat roller 2 and press roller 3. The intermediate transfer medium 50 and print paper 60, with a toner image being caught therebetween, are heated and pressed by being rolled in the gap between these two rollers, as mentioned previously.

In the transfer-fixing section B, the intermediate transfer medium 50 and print paper 60 in tight face-contact with each other are heated, causing the toner to fuse into a film. For the efficient heat transmission to toner, it is necessary for the intermediate transfer medium 50 and print paper 60 to be in tight face-contact with each other. If air is confined in some areas, the toner image does not fuse evenly and the resulting uneven transfer-fixing and "offset" phenomenon deteriorate the print quality. In order to ensure the tight face-contact between the intermediate transfer medium 50 and print paper 60, the medium 50 is provided on its surface with a resilient layer. The heat roller 2 and press roller 3 are also coated with resilient layers for producing a uniform pressure. Specifically, the heat roller 2 has a thinner resilient layer so that it efficiently heats toner on the intermediate transfer medium 50, while the press roller 3 has a thicker resilient layer to provide a soft rolling section. As a result, the heat roller 2 having a thinner resilient layer sinks into the general profile of press roller 3 having a thicker resilient layer, causing the rolling section to have a curvature C which is greater than or equal to the reciprocal of the radius r of the sinking roller 2 ($1/r \geqq C$). Due to the provision of resilient layers on both rollers, the curvature C is generally smaller than 1/r.

The inventors of the present invention conducted various experiments and found that the creation of creases on the print paper was attributable to the curve of the rolling section, as will be explained in the following.

Figure 1:
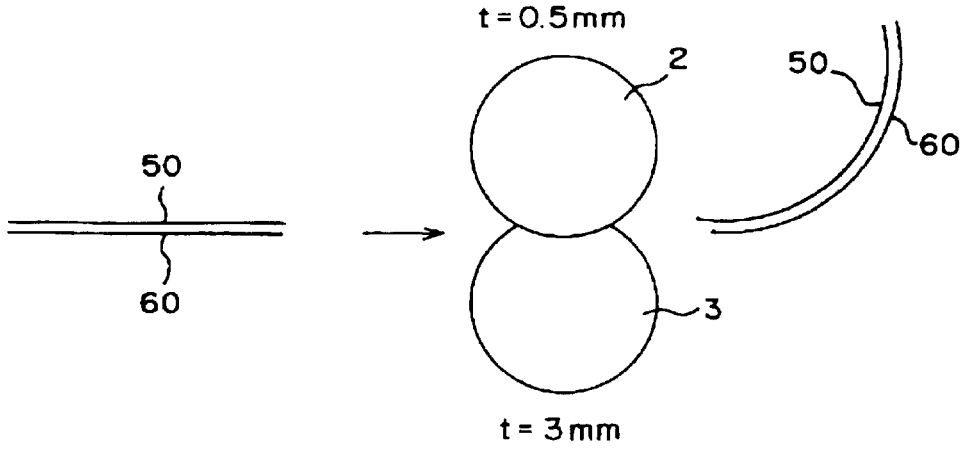
FIG. 1 is a diagram showing in a sense of model the curling of an intermediate transfer medium and print paper in tight face-contact with each other.
Figure 2:
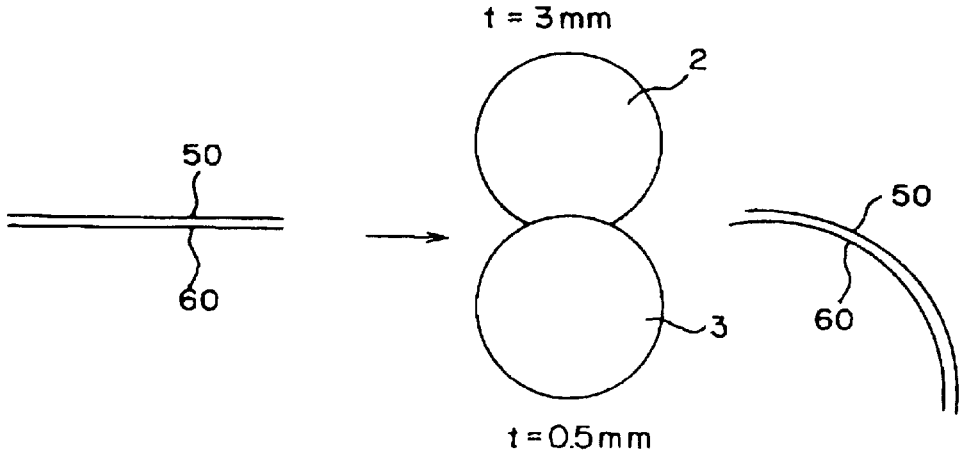
FIG. 2 is a diagram showing in a sense of model the curling of an intermediate transfer medium and print paper in tight face-contact with each other.

Initially, the heat roller 2 and press roller 3 were provided with resilient layers of various thicknesses so that the rolling section of the transfer-fixing section B caused its curvature C to vary, and a strip of intermediate transfer medium 50 and print paper 60 in face-contact with each other were driven to pass through the rolling section. FIG. 1 and FIG. 2 show the shapes of the intermediate transfer medium 50 and print paper 60 in tight face-contact with each other after they have passed through the rolling section. FIG. 1 shows the result for a heat roller 2 with a resilient layer having a thickness of t=0.5 mm and a press roller 3 with a resilient layer having a thickness of t=3 mm. FIG. 2 shows the result for a heat roller 2 with a resilient layer having a thickness of t=3 mm and a press roller 3 with a resilient layer having a thickness of t=0.5 mm. These figures reveal that the intermediate transfer medium 50 and print paper 60, which have been pressed to be in tight face-contact with each other in the rolling section, come out of the rolling section while curling depending on the curvature of rolling section. The reason for this outcome is that as a result of heat-pressing for face-contact members in a curly state, the outer member elongates and the inner member contracts causing a gap between the outer and inner circumferential lengths, and the resulting tight face-contact members retain the curvature to curl.

Figure 3:
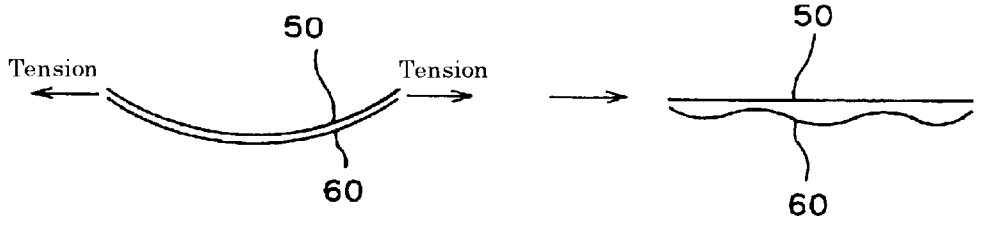
FIG. 3 is a diagram showing in a sense of model a curling intermediate transfer medium and print paper in tight face-contact with each other, with a tension being applied thereto.
Figure 4:
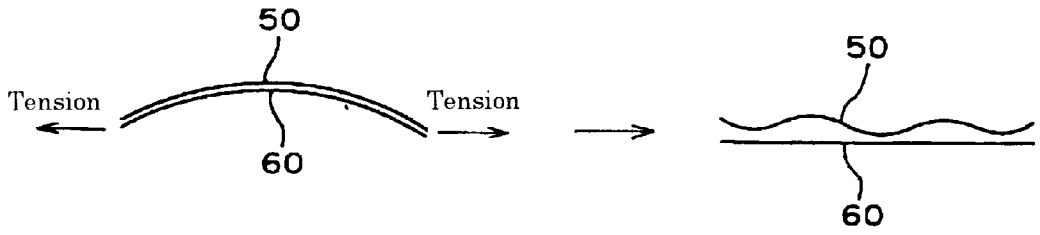
FIG. 4 is a diagram showing in a sense of model a curling intermediate transfer medium and print paper in tight face-contact with each other, with a tension being applied thereto.

Subsequently, a tension was applied to the curling face-contact intermediate transfer medium 50 and print paper 60 produced in the above-mentioned first experiment to straighten them. FIG. 3 shows the application of tension to the tight face-contact inner intermediate transfer medium 50 and outer print paper 60 derived from FIG. 1, and FIG. 4 shows the application of tension to the tight face-contact outer intermediate transfer medium 50 and inner print paper 60 derived of FIG. 2. These figures reveal that as a result of the application of tension, the intermediate transfer medium 50 and print paper 60 separate partially from each other, causing the outer member to create creases.

Based on these experiments, the inventors of the present invention inferred for the cause of creases on the print paper as follows. In the rolling section, the heat roller 2, intermediate transfer medium 50, print paper 60, and press roller 3 are in contact tandem in this order, with the heat roller 2 having a thin resilient layer sinking into the general profile of press roller 3 having a thick resilient layer. Consequently, the intermediate transfer medium 50 becomes the inner member and the print paper 60 becomes the outer member, as demonstrated by the above-mentioned first experiment. At the position after the rolling section, the curling intermediate transfer medium 50 under tension is pulled straight, and the medium 50 and paper 60 separate partially in parallel each other in the direction vertical to the direction of tension, causing the outer print paper 60 to create creases, as demonstrated by the above-mentioned second experiment. The resulting creases produce the uneven polish, as mentioned previously.

One conceivable manner of suppressing the emergence of creases is to equalize the outer length and inner length of the intermediate transfer medium 50 and print paper 60 in tight face-contact with each other.

Figure 5:
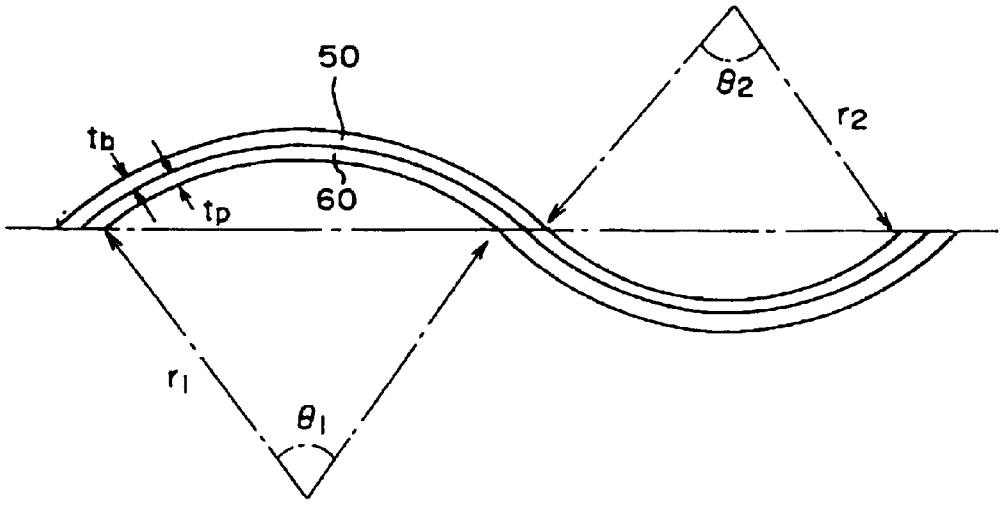
FIG. 5 is a diagram showing in a sense of model an intermediate transfer medium and print paper in tight face-contact with each other, with their curling direction being reverse at a longitudinal mid point.

FIG. 5 shows a scheme, in which the curling direction of the intermediate transfer medium 50 and print paper 60 in tight face-contact with each other is reversed at a longitudinal mid point.

With the curling direction being reversed as shown in FIG. 5, the difference L of the outer and inner lengths is formulated in terms of the thickness tp (mm) of print paper 60, the thickness tb (mm) of intermediate transfer medium 50, the rolling angle θ1 (rad) of the rolling section, and the reversed rolling angle θ2 (rad), as follows.

$$L=(tb+tp)\cdot(\theta 1-\theta 2)$$

Accordingly, the difference of inner and outer lengths can be nullified by making the rolling angle q1 and reversed rolling angle θ2 equal. Actually, however, due to the thermal contraction and expansion of the paper 60 and medium 50, the difference of inner and outer lengths is dissolved in the presence of a small difference between the rolling angle θ1 and reversed rolling angle θ2. The radius r1 of the rolling section and the radius r2 of the reverse rolling section are also shown in FIG. 5.

Instead of the midway reversion of curling direction shown in FIG. 5, the rolling section maybe rid of the curvature so that the inner and outer lengths do not differ. Alternatively, separation of the intermediate transfer medium 50 and print paper 60 can be prevented by keeping the curl of tight face-contact medium 50 and paper 60 caused by the difference of inner and outer lengths even after the rolling section. In this case, the medium 50 and paper 60 can have their curly state kept at the value of curvature of the rolling section through the application of an external force, or can have their curly state kept through the relief of the external force which manages the curly state of the medium 50 and paper 60.

(Embodiment 1)

Figure 6:
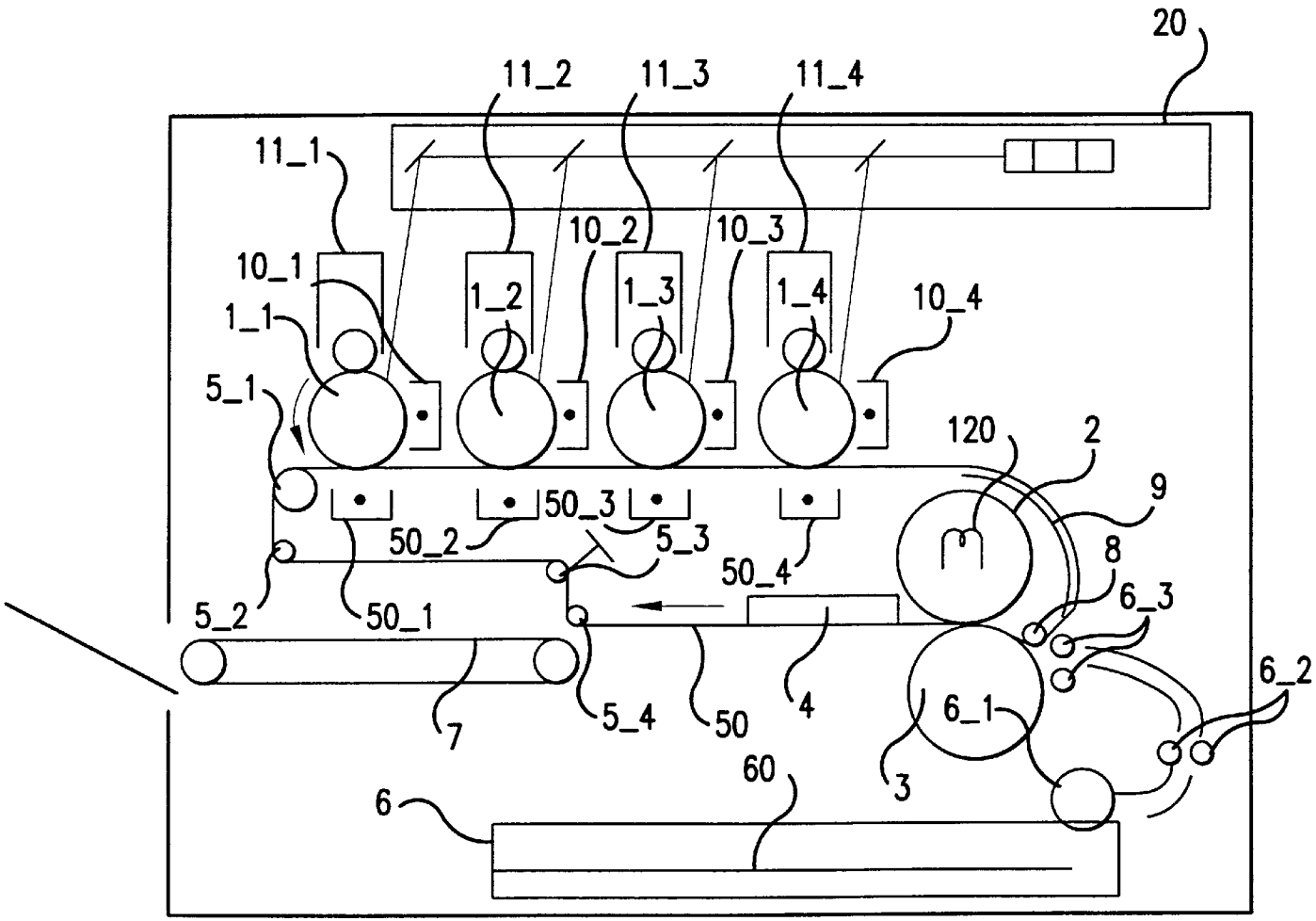
FIG. 6 is a schematic diagram showing an image forming apparatus based on a first embodiment of this invention.

FIG. 6 shows the structure of the image forming apparatus based on the first embodiment of this invention.

This embodiment is derived from the first image forming apparatus based on the first image forming method mentioned previously. In the apparatus, the heat-pressing means includes two rollers which roll a toner image retaining medium (an endless intermediate transfer belt in this embodiment) in their arcuate rolling section where one roller sinks into the general profile of another (first) roller, a medium path defining member which defines the carrying path of the toner image retaining medium so that the medium is carried along the profile of the first roller before it reaches the rolling section, and a recording medium carrying device feeds a sheet of recording medium so that it is caught between the first roller and the toner image retaining medium which running along the profile of the first roller.

The endless intermediate transfer belt 50 is looped to run around rollers 5-1, 5-2, 5-3, and 5-4, a heat plate 9 and a curl reversing roller 8 in the direction shown by the arrow. A heat roller 2 and press roller 3 are disposed to confront each other. The heat roller 2 and press roller 3 may have their positions exchanged. The press roller 3 may be a heat roller which incorporates a heat source. The heat plate 9 has a built-in heat source. Disposed along the intermediate transfer medium 50 are a train of four photosensitive members 1-1, 1-2, 1-3, and 1-4, which are charged uniformly by respective chargers 10-1, 10-2, 10-3, and 10-4, and thereafter exposed to scanning light beams, which are modulated by the light beam pulse-width modulator (not shown) in response to the image density signals, from a light beam scanning device 20, and static latent images are formed on their surfaces. The static latent images are developed with toners of black, yellow, magenta, and cyanine by respective developers 11-1, 11-2, 11-3, and 11-4, so that toner images of these colors, with their density being rendered the area modulation, are formed on the respective photosensitive members. The toner images of all colors are transferred onto the intermediate transfer belt 50 one by one by the operation of respective transfer devices 50-1, 50-2, 50-3, and 50-4 so that a multi-color toner image is formed on it.

The intermediate transfer belt 50, with the toner image being formed thereon, is brought in contact with the heat plate 9, by which toner is heated to fuse.

The press roller 3 comes in contact with the heat roller 2 by being timed to the feeding of the print paper 60 from the paper tray 6. The multi-color toner image between the intermediate transfer belt 50 and print paper 60 is pressed at first by the press roller 3 and the intermediate transfer belt 50, and subsequently pressed more strongly and heated during the passage between the heat roller 2 and press roller 3. Toner heated above the fusing temperature softens, fuses and soaks into the print paper 60, and it will solidify to complete the transfer-fixing process. A cooling device 4 cools the face-contact intermediate transfer belt 50 and print paper 60 coming out of the heating zone, and consequently toner solidifies and adheres strongly to the print paper 60, and the toner image is fixed on it. The face-contact intermediate transfer belt 50 and print paper 60 cooled by the cooling device 4 are further carried to a separating roller 5-4 having a small radius, by which the print paper 60 separates based on its stiffness from the intermediate transfer belt 50, and the paper 60 has a color picture formed of the toner image fixed on it. The toner image transferred and fixed onto the print paper 60 has the rendition of the smoothness of the surface of intermediate transfer belt 50, and it highly polishes.

The photosensitive members 1-1, 1-2, 1-3 and 1-4 can use various inorganic photosensitive substances (Se, a-Si, a-SiC, CdS, etc.) and also various organic substances.

Toner is made of heat-plastic binder including coloring substances of yellow, magenta, cyanine, etc., and it can be made from commercially available materials. This embodiment uses toner having a weight average molecular weight (Mw) of 54000, fusing temperature (Tm) of 120° C., viscosity at fusing point (h) of 4000 Pas, and average particle diameter of 7 mm. The exposure condition and developing condition are set so that the quantity of toner of each color deposited on the print paper 60 ranges from 0.4 mg/cm$^2$ to 0.7 mg/cm$^2$ in general depending on the amount of coloring substance included. In this embodiment, these conditions are set to achieve 0.65 mg/cm$^2$ for toner of all colors.

The intermediate transfer belt 50 has the 2-layer structure including a base layer and a surface layer.

The base layer is made of polyimide film of 70-mm thickness added by carbon black. The base layer has its volume resistivity set to $10^{10}$ Wm based on the adjustment of the amount of additive carbon black so that electrostatic transfer of a toner image from the photosensitive member onto the intermediate transfer medium takes place stably. Materials useful for the base layer include polymer sheets having a high thermal durability and a thickness of 10–300 mm of polyester, polyethylene terephtalate, polyethel sulfone, polyethel ketone, polysulfone, polyimide, polyimiamid, polyamide, etc.

The surface layer of the intermediate transfer belt 50 has its volume resistivity set to $10^{14}$ Wm so that electrostatic transfer of a toner image from the photosensitive member onto the intermediate transfer medium takes place stably, and it is made of silicon copolymer having 30-degree rubber hardness and 50-mm thickness so that the intermediate transfer medium and print paper, with a toner image being caught therebetween, come in tight face-contact with each other at the simultaneous transfer-fixing process from the intermediate transfer medium to the print paper. Silicon copolymer is most suitable for the surface layer which transfers toner to the print paper owing to its elasticity, surface viscosity to toner at the room temperature, and nature of easy release of molten toner.

The heat plate 9 is an aluminum plate having 2-mm thickness and 220-mm length in the medium carrying direction, with a silicon rubber heater being attached to the rear side. The heating temperature is controlled such that the toner temperature in the area where the intermediate transfer medium and print paper are in contact with each other is kept at the toner fusing temperature (Tm) or higher. The heat plate 9 may alternatively employ a ceramic heater.

The heat roller 2 and press roller 3 are metallic rollers or metallic rollers coated with a heat-resistive resilient layer of silicon rubber or the like. The heat roller 2 incorporates a halogen lamp for the heat source 120, and the heating temperature is controlled such that the toner temperature of the heating area is kept at the toner fusing temperature (Tm) or higher. Specifically, the heat roller 2 having 50-mm outer diameter is made of an aluminum bore cylinder coated with a silicon rubber layer having 30-degree hardness and 0.5-mm thickness. The press roller 3 having 50-mm outer diameter is made of an aluminum bore cylinder coated with a silicon rubber layer having 30-degree hardness and 3-mm thickness. The heat roller 2 incorporates a halogen lamp for the heat source 120. The heat and press rollers have their pressing force adjusted such that the rolling section has a length of contact in the medium carrying direction (will be termed "contact length") of 7.5 mm, in which the heat roller 2 sinks into the general profile of press roller 3.

Figure 7:
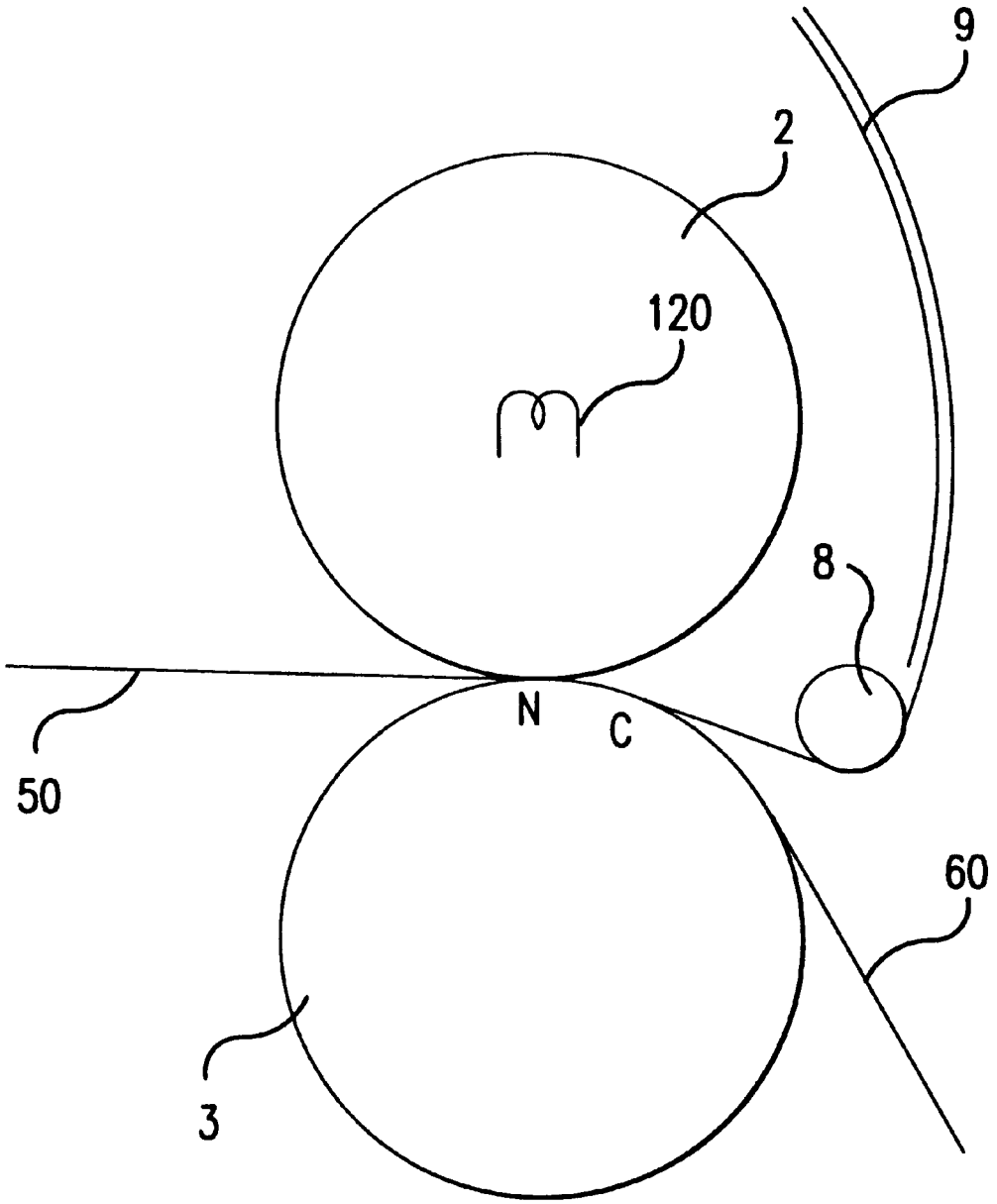
FIG. 7 is a schematic diagram showing enlargedly part of the image forming apparatus of the first embodiment.
Figure 8:
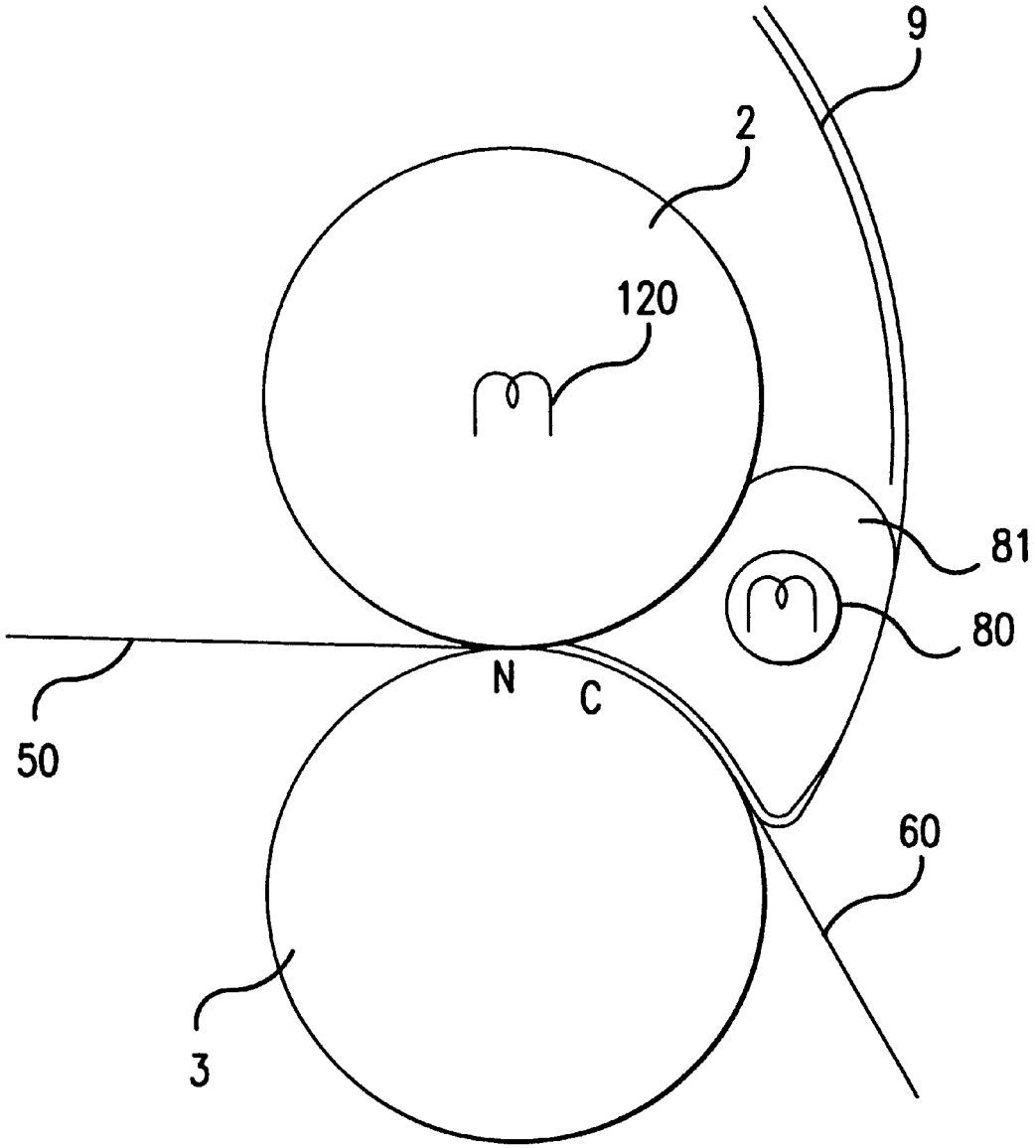
FIG. 8 is a schematic diagram showing a variant arrangement of part of the first embodiment.
Figure 9:
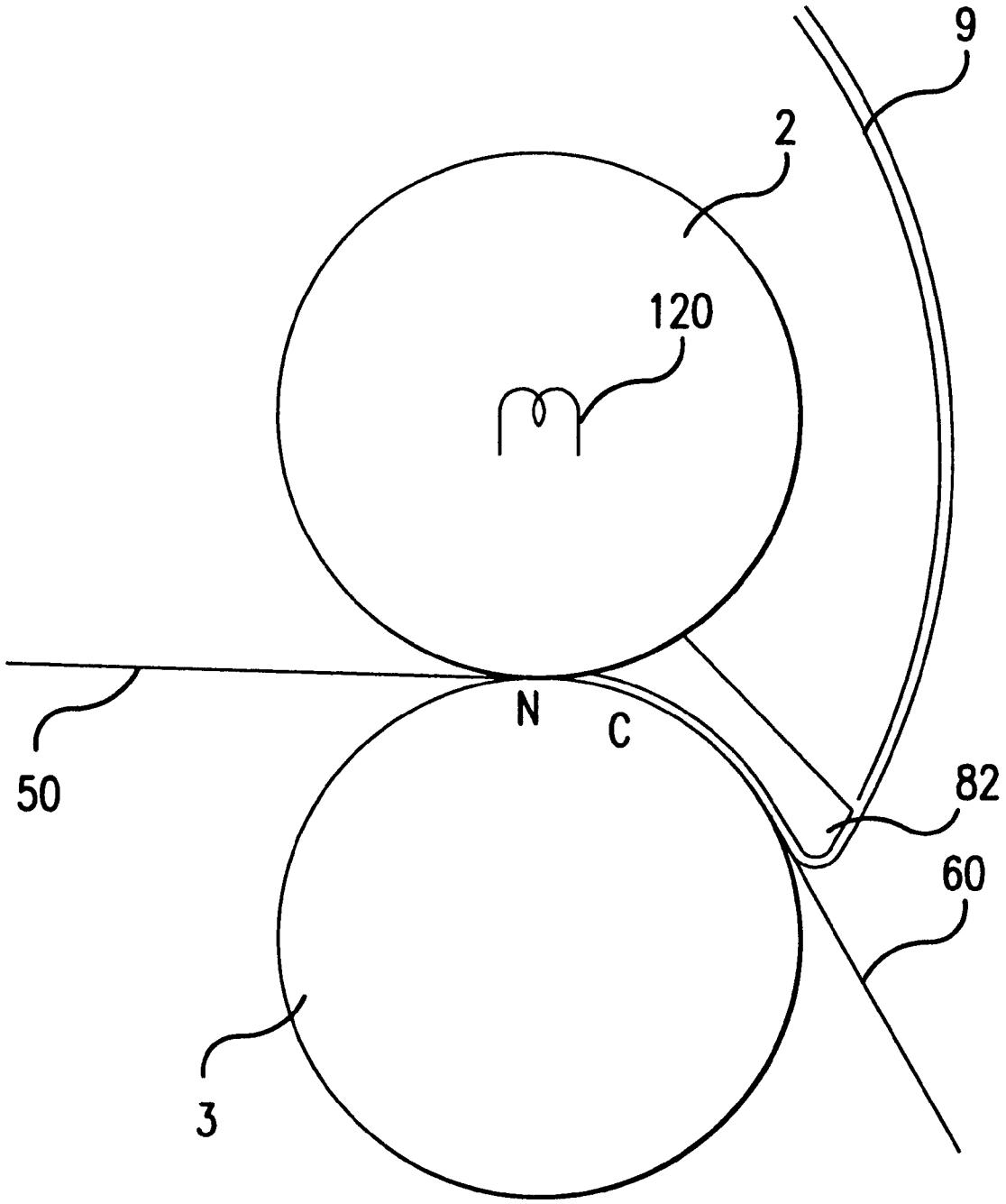
FIG. 9 is a schematic diagram showing another variant arrangement of part of the first embodiment.

The curl reversing roller 8 is a stainless steel bore roller having 25-mm diameter coated with silicon rubber of 1-mm thickness with the intention of thermal insulation against the intermediate transfer belt 50. FIG. 7 shows the arrangement of these rollers 2, 3, and 8. The curl reversing roller 8 presses the intermediate transfer belt 50 onto the press roller 3 before it enters the rolling section between the heat roller 2 and press roller 3. Accordingly, the intermediate transfer belt 50 having the toner image is pressed through the print paper 60 onto the press roller 3. As a result, an counter arcuate section C having the curving direction opposite to the rolling section N is created. The counter arcuate section C has its width adjusted by varying the position of the curl reversing roller 8. The width of arcuate section C is set to 6.5 mm in this embodiment. In addition to the structure using the curl reversing roller 8 for creating the counter arcuate section C, another structure based on a wedge-type metallic member 81 which incorporates a heat source 80 as shown in FIG. 8, or still another structure based on a bar pad 82 coated on its surface with a thermal insulation layer as shown in FIG. 9 may be employed.

For the print paper 60, J-paper and S-paper manufactured by Fuji Xerox Co., Ltd. are used as ordinary paper and thin paper, respectively, and Shiraoi-paper manufactured by Daishowa Paper Mfg. Co., Ltd. is used as thick paper. The J-paper, S-paper and Shiraoi-paper have ten-point average thicknesses of about 96 mm, 76 mm and 210 mm, respectively.

The image forming apparatus uses a screen of vertical thin lines consisting of 200 lines.

The image forming apparatus of the foregoing structure was operated to print images on sheets of ordinary paper (J-paper), thin paper (S-paper) and thick paper (Shiraoi-paper) at a carrying speed (transfer-fixing speed) of 240 mm/s thereby to assess the emergence of paper creases and uneven polish. Satisfactory print results without the emergence of paper creases or uneven polish were obtained.

(Embodiment 2)

Figure 10:
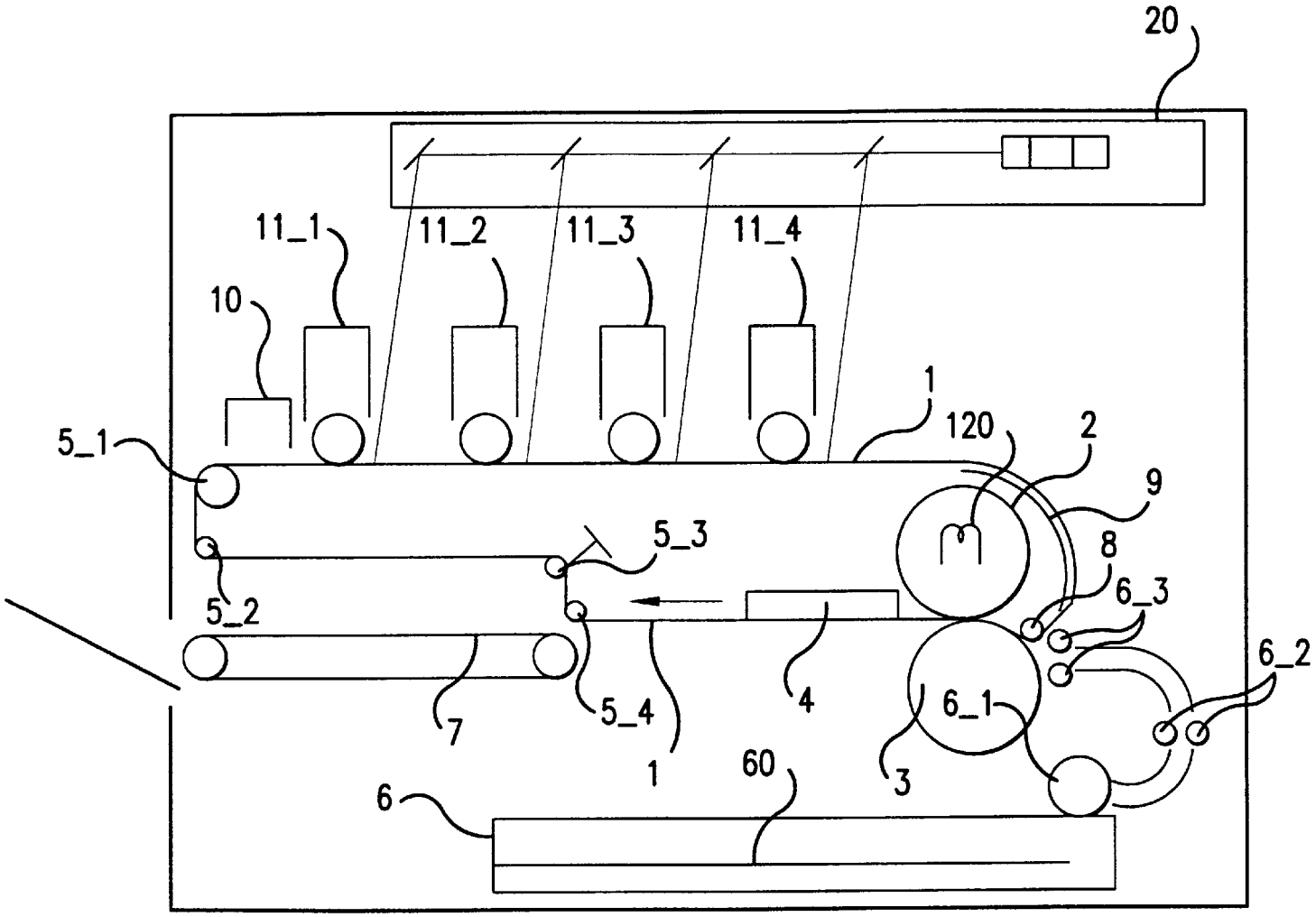
FIG. 10 is a schematic diagram showing an image forming apparatus based on a second embodiment of this invention.

FIG. 10 shows the structure of the image forming apparatus based on the second embodiment of this invention.

This embodiment is also derived from the first image forming apparatus based on the first image forming method, as in the case of the preceding embodiment shown in FIG. 6.

The apparatus includes a photosensitive member 1 of the belt type, which is looped to run around rollers 5-1, 5-2, 5-3, and 5-4, a heat plate 9 and a curl reversing roller 8 in the direction shown by the arrow. A heat roller 2 and press roller 3 are disposed to confront each other. The heat roller 2 and press roller 3 may have their positions exchanged. The press roller 3 may be a heat roller which incorporates a heat source. The photosensitive belt 1 is charged uniformly by a charger 10, and thereafter exposed to scanning light beams, which are modulated by the light beam pulse-width modulator (not shown) in response to the image density signals, from a light beam scanning device 20, and static latent images are formed sequentially on it. The static latent images are developed with toners of black, yellow, magenta and cyanine by respective developers 11-1, 11-2, 11-3 and 11-4 sequentially, so that a multi-color toner image, with its density being rendered the area modulation, is formed on the photosensitive belt 1.

The photosensitive belt 1, with the toner image being formed thereon, is brought in contact with the heat plate 9, by which toner is heated to fuse.

The press roller 3 comes in press contact with the heat roller 2 by being timed to the feeding of the print paper 60 from the paper tray 6. The multi-color toner image between the photosensitive belt 1 and print paper 60 is pressed at first by the press roller 3 and the photosensitive belt 1, and subsequently pressed more strongly and heated during the passage between the heat roller 2 and press roller 3. Toner heated above the fusing temperature softens, fuses and soaks into the print paper 60, and it will solidify to complete the transfer-fixing process. A cooling device 4 cools the photosensitive belt 1 and print paper 60 so that the toner image solidifies, and the transferred toner image is fixed on it. The photosensitive belt 1 and print paper 60 cooled by the cooling device 4 are further carried to a separating roller 5-4 having a small radius, by which the print paper 60 separates based on its stiffness from the photosensitive belt 1, and the paper 60 has a color picture formed of the multi-color toner image fixed on it. The toner image transferred and fixed on the print paper 60 has the rendition of the smoothness of the surface of photosensitive belt 1, and it highly polishes.

The photosensitive belt 1 can use various photosensitive substances (Se, a-Si, a-SiC, CdS, etc.) having the thermal stability.

Toner having the same properties as the first embodiment is used, and the quantity of toner on the print paper is set to 0.65 mg/cm$^2$ for all colors as in the case of the first embodiment.

The heat plate 9 used in this embodiment is identical to the one used in the first embodiment.

The heat plate 9, heat roller 2, press roller 3, and curl reversing roller 8 used in this apparatus are all identical to the counterparts of the first embodiment.

For the print paper 60, J-paper and S-paper manufactured by Fuji Xerox Co., Ltd. and Shiraoi-paper manufactured by Daishowa Paper Work Mfg. Co., Ltd. are used, as in the case of the first embodiment.

The screen is vertical thin lines consisting of 200 lines, as in the case of the first embodiment.

The image forming apparatus of the foregoing structure was operated to print images on sheets of ordinary paper (J-paper), thin paper (S-paper) and thick paper (Shiraoi-paper) at a carrying speed (transfer-fixing speed) of 240 mm/s thereby to assess the emergence of paper creases and uneven polish. Satisfactory print results without the emergence of paper creases or uneven polish were obtained.

(Embodiment 3)

Figure 11:
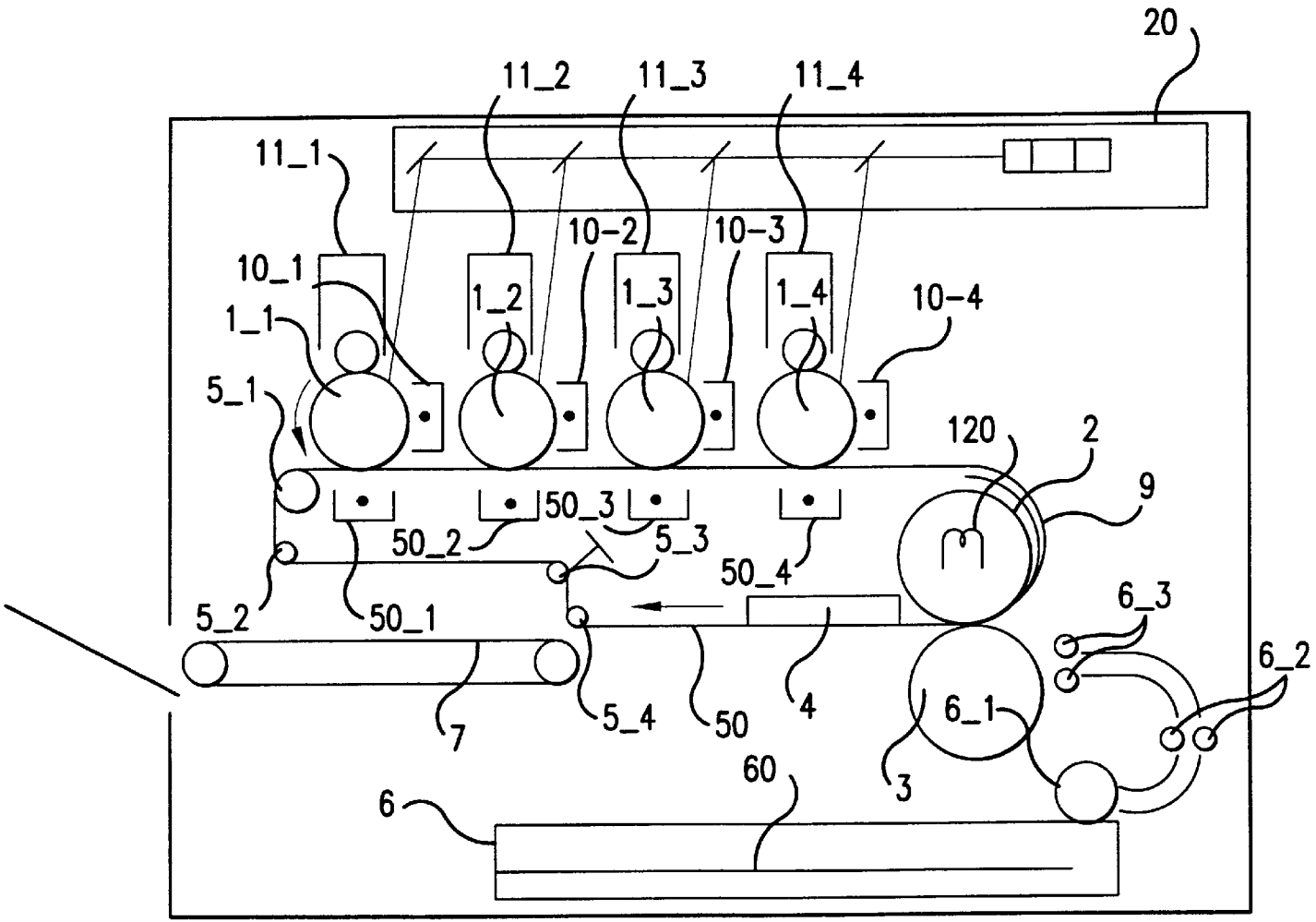
FIG. 11 is a schematic diagram showing an image forming apparatus based on a third embodiment of this invention.

FIG. 11 shows the structure of the image forming apparatus based on the third embodiment of this invention. This embodiment is derived from the first image forming apparatus based on the first image forming method mentioned previously. The apparatus includes a heat-pressing means made up of two rollers of the same material and same diameter, which roll the toner image retaining medium and recording medium in face-contact with each other.

In the structure of the image forming apparatus shown in FIG. 11, the intermediate transfer belt 50, photosensitive members 1-1, 1-2, 1-3, and 1-4 which form toner images on the intermediate transfer belt 50, chargers 10-1, 10-2, 10-3, and 10-4, light beam scanning device 20, developers 11-1, 11-2, 11-3, and transfer devices 50-1, 50-2, 50-3, and 50-4 are all identical to the counterparts of the first embodiment shown in FIG. 6, and explanation thereof will be omitted.

The heat plate 9, which is similar to the counterpart of the first embodiment shown in FIG. 6, has its one end on the downstream side on the carrying path adjusted in height so that the intermediate transfer belt 50 is guided to the rolling section between the heat roller 2 and press roller 3 without having contact with the press roller 3.

Both the heat roller 2 and press roller 3 having 50-mm outer diameter are made of aluminum bore cylinders coated with silicon rubber layers having 30-degree hardness and 3-mm thickness. The heat roller 2 incorporates a halogen lamp for the heat source 120. The heat and press rollers have their pressing force adjusted to provide a contact length of 7.5 mm. The rolling section is visually observed to be virtually linear along the axial direction instead of being arcuate.

The image forming apparatus of the foregoing structure was operated to print images on sheets of ordinary paper (J-paper), thin paper (S-paper) and thick paper (Shiraoi-paper) at a carrying speed (transfer-fixing speed) of 240 mm/s thereby to assess the emergence of paper creases and uneven polish. Satisfactory print results without the emergence of paper creases or uneven polish were obtained.

(Embodiment 4)

Figure 12:
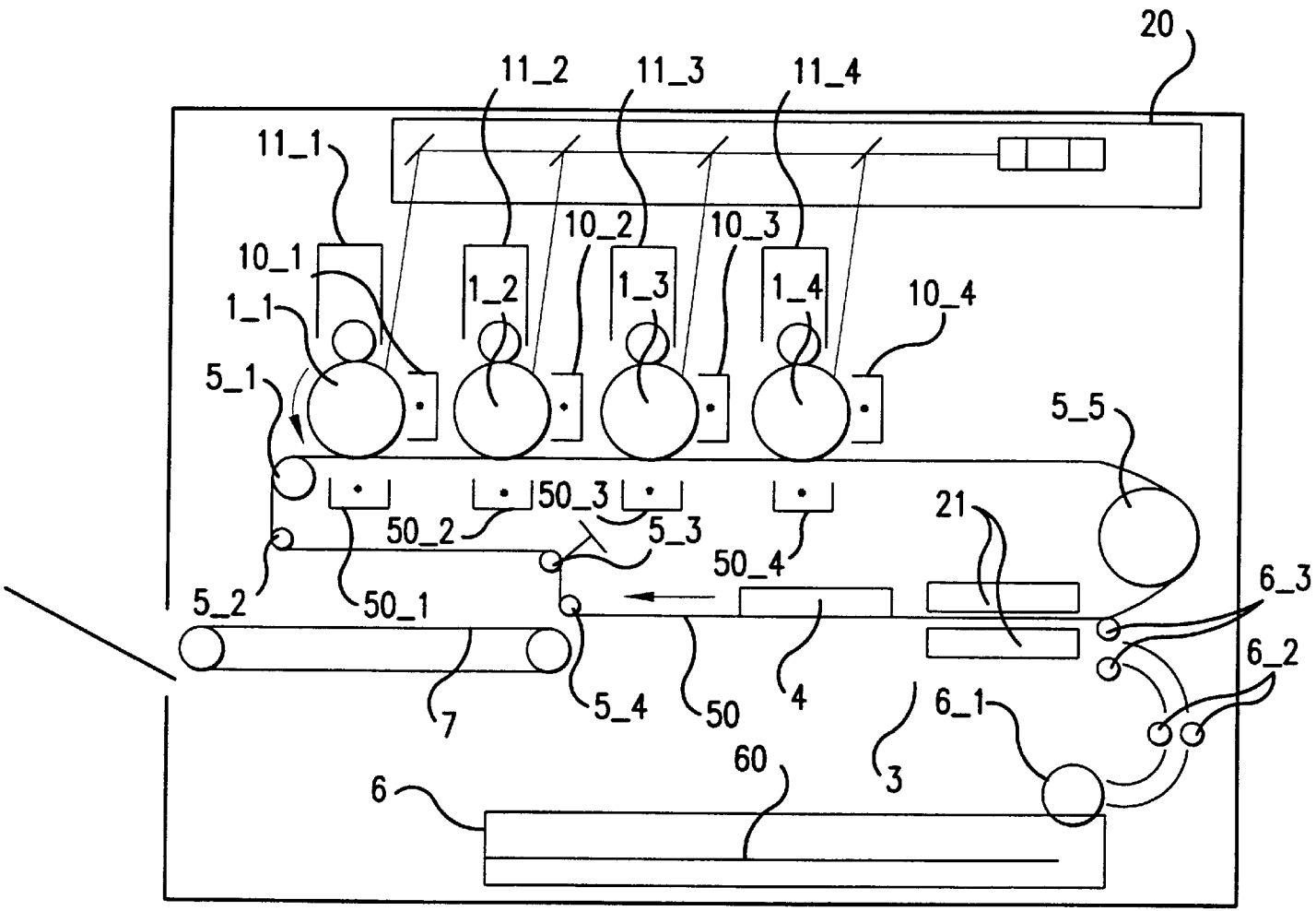
FIG. 12 is a schematic diagram showing an image forming apparatus based on a fourth embodiment of this invention.

FIG. 12 shows the structure of the image forming apparatus based on the fourth embodiment of this invention.

This embodiment is also derived from the first image forming apparatus based on the first image forming method as in the case of the preceding embodiment shown in FIG. 11, with a difference being that the apparatus includes a heat-pressing means made up of two members which press between their planar surfaces the toner image retaining medium and recording medium in face-contact with each other.

In the structure of the image forming apparatus shown in FIG. 12, the intermediate transfer belt 50, photosensitive members 1-1, 1-2, 1-3, and 1-4 which form toner images on the intermediate transfer belt 50, chargers 10-1, 10-2, 10-3, and 10-4, light beam scanning device 20, developers 11-1, 11-2, 11-3, and transfer devices 50-1, 50-2, 50-3, and 50-4 are all identical to the counterparts of the first embodiment shown in FIG. 6, and explanation thereof will be omitted.

The intermediate transfer belt 50 is looped to run around the rollers 5-1, 5-2, 5-3, 5-4, and 5-5 in the direction shown by the arrow.

The heat-pressing plates 21 are a pair of aluminum plates having 2-mm thickness and 130-mm length in the belt carrying direction, with silicon rubber heaters being attached to the outer sides thereof. The plates 21 are coated in their sections in contact with the intermediate transfer belt 50 and print paper 60 with TEFLON polytetrafluoroethylene resin layers having 10-mm thickness for the reduction of friction. The heating temperature is controlled such that the toner temperature in the heating area is kept at the toner fusing temperature (Tm) or higher. The pair of heat-pressing plates 21 are pushed face to face by means of a pressing device (not shown), and have their contact pressure adjusted to 3 $kg/cm^2$. The heat-pressing section is visually observed to be virtually linear.

The image forming apparatus of the foregoing structure was operated to print images on sheets of ordinary paper (J-paper), thin paper (S-paper) and thick paper (Shiraoi-paper) at a carrying speed (transfer-fixing speed) of 160 mm/s thereby to assess the emergence of paper creases and uneven polish. Satisfactory print results without the emergence of paper creases or uneven polish were obtained.

(Embodiment 5)

Figure 13:
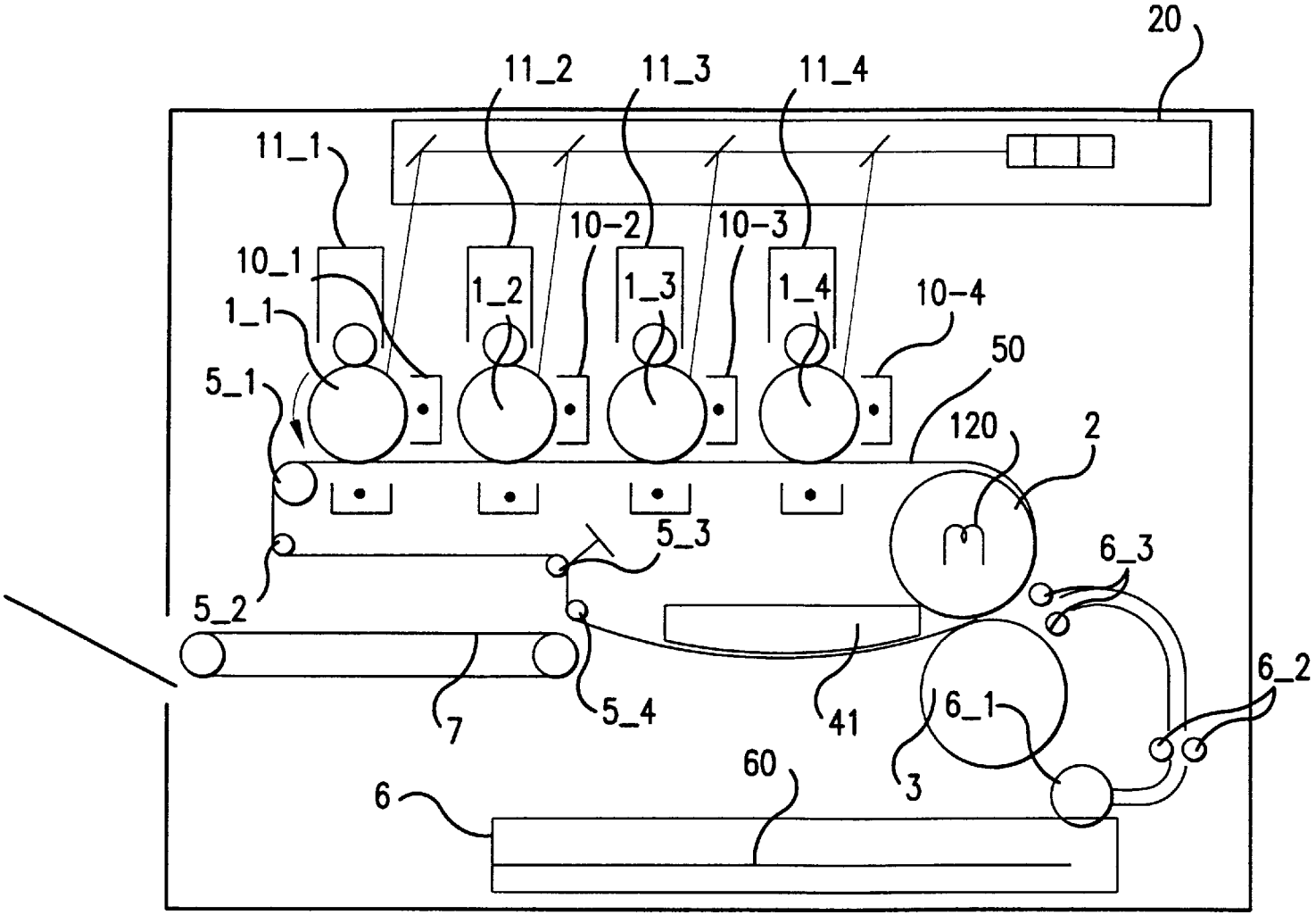
FIG. 13 is a schematic diagram showing an image forming apparatus based on a fifth embodiment of this invention.

FIG. 13 shows the structure of the image forming apparatus based on the fifth embodiment of this invention. This embodiment is derived from the third image forming apparatus based on the third image forming method mentioned previously.

In the structure of the image forming apparatus shown in FIG. 13, the intermediate transfer belt 50, photosensitive members 1-1, 1-2, 1-3, and 1-4 which form toner images on the intermediate transfer belt 50, chargers 10-1, 10-2, 10-3, and 10-4, light beam scanning device 20, developers 11-1, 11-2, 11-3, and transfer devices 50-1, 50-2, 50-3, and 50-4 are all identical to the counterparts of the first embodiment shown in FIG. 6, and explanation thereof will be omitted.

The intermediate transfer belt 50 is looped to run around the rollers 5-1, 5-2, 5-3, and 5-4 and the heat roller 2 in the direction shown by the arrow.

The intermediate transfer belt 50, with multi-color toner images being formed thereon, is heated when it runs around the heat roller 2, causing toner to fuse.

The heat roller 2 and press roller 3 having 80-mm outer diameter are made of aluminum bore cylinders coated with silicon rubber layers having 30-degree hardness and 1-mm and 3-mm thicknesses, respectively. The heat roller 2 incorporates a halogen lamp for the heat source 120. The rollers 2 and 3 have their pressing force adjusted to have a contact length of 6.5 mm, in which the heat roller 2 sinks into the general profile of press roller 3.

The press roller 3 comes in press contact with the heat roller 2 by being timed to the feeding of the print paper 60 from the paper tray 6. The intermediate transfer belt 50 and print paper 60 in face-contact with each other, with molten multi-color toner being caught therebetween, is driven to run through the passage between the heat roller 2 and press roller 3 so that they are heated. Toner heated above the fusing temperature softens, fuses and soaks into the print paper 60, and it will solidify to complete the transfer-fixing process.

A cooling device 41 has a curved guide surface which is shaped to have the same curvature as the curving of the intermediate transfer belt 50 and print paper 60 at the passage in the rolling section between the heat roller 2 and press roller 3. Accordingly, the intermediate transfer belt 50 and print paper 60 are carried by being in tight face-contact with each other to the separating roller 5-4. The cooling device 41 cools the face-contact intermediate transfer belt 50 and print paper 60 coming out of the heating zone, and consequently toner solidifies and adheres strongly to the print paper 60, and the toner image is fixed on it.

The intermediate transfer belt 50 and print paper 60 cooled by the cooling device 41 are further carried to the separating roller 5-4 having a small radius, by which the print paper 60 separates based on its own stiffness from the transfer belt 50, and the paper 60 has a color picture fixed on it. The toner image transferred and fixed on the print paper 60 has the rendition of the smoothness of the surface of intermediate transfer belt 50, and it highly polishes.

The image forming apparatus of the foregoing structure was operated to print images on sheets of ordinary paper (J-paper), thin paper (S-paper) and thick paper (Shiraoi-paper) at a carrying speed (transfer-fixing speed) of 120 mm/s thereby to assess the emergence of paper creases and uneven polish. Satisfactory print results without the emergence of paper creases or uneven polish were obtained.

(Embodiment 6)

Figure 14:
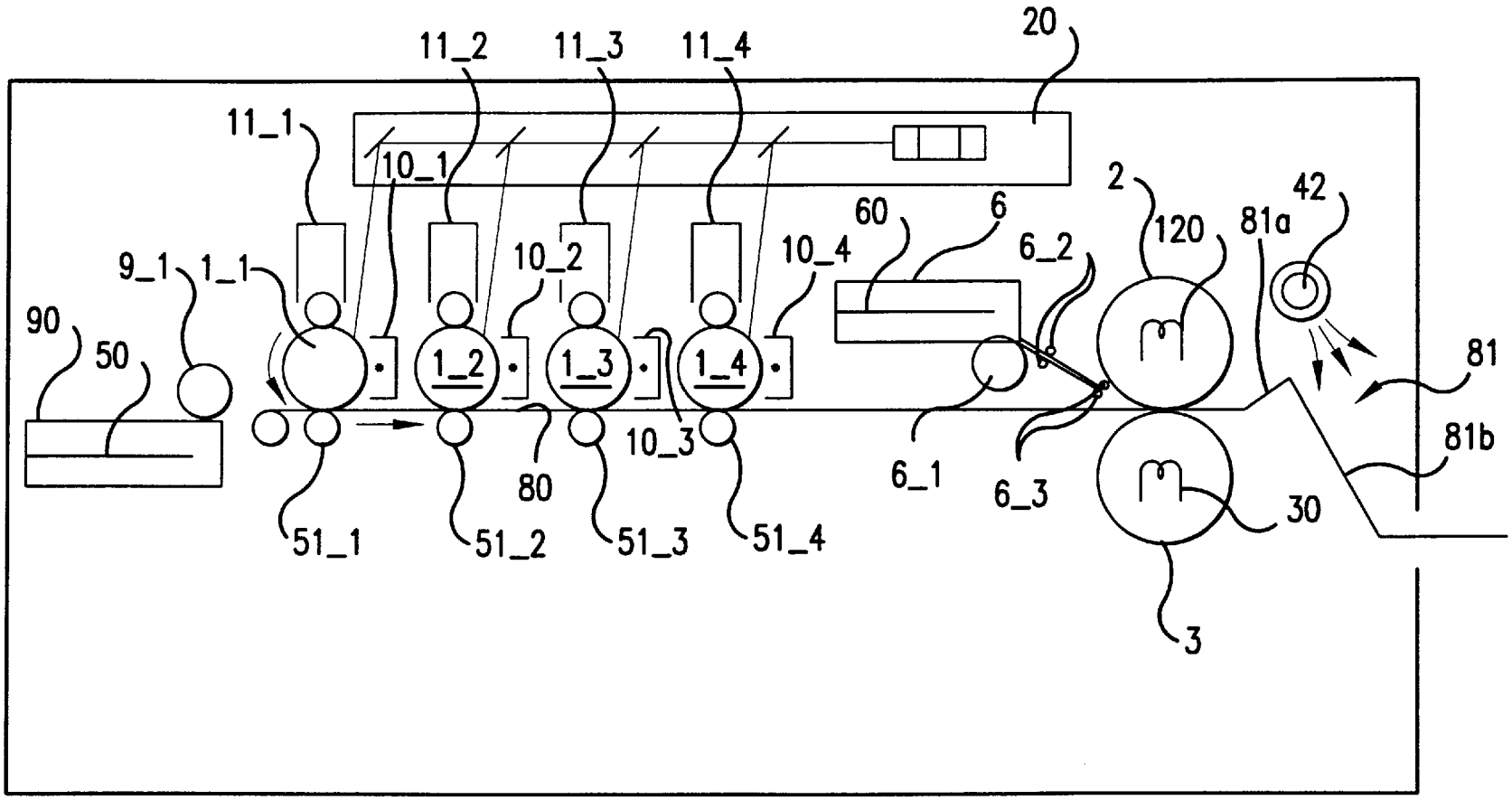
FIG. 14 is a schematic diagram showing an image forming apparatus based on a sixth embodiment of this invention.

FIG. 14 shows the structure of the image forming apparatus based on the sixth embodiment of this invention. This embodiment is derived from the fourth image forming apparatus based on the fourth image forming method.

In the structure of the image forming apparatus shown in FIG. 14, the photosensitive members 1-1, 1-2, 1-3, and 1-4 which form toner images on the intermediate transfer medium 50, chargers 10-1, 10-2, 10-3, and 10-4, light beam scanning device 20, and developers 11-1, 11-2, 11-3, are all identical to the counterparts of the first embodiment shown in FIG. 6, and explanation thereof will be omitted.

The intermediate transfer medium 50 is similar to the one used in the first embodiment, but it is a sheet of medium instead of an endless belt. A medium feeder 9-1 is operated to supply sheets of intermediate transfer medium 50 one by from a sheet tray 90 one. Toner images of four colors formed on the photosensitive members 1-1, 1-2, 1-3, and 1-4 are transferred sequentially onto the intermediate transfer sheet 50 by the respective transfer rollers 51-1, 51-2, 51-3, and 51-4 so that a multi-color toner image is formed on the transfer sheet 50.

The intermediate transfer sheet 50 which retains the multi-color toner image comes in face-contact with a sheet of print paper 60 which is supplied from the paper tray 6 by being timed to the arrival of the transfer sheet 50, and the transfer sheet 50 and paper 60, with the toner image being caught therebetween, are carried into the rolling section where the press roller 3 comes in press contact with the heat roller 2 by being timed to the feeding of the print paper 60 so that they are heat-pressed.

Toner heated above the fusing temperature softens, fuses and soaks into the print paper 60, and it will solidify to complete the transfer-fixing process.

The face-contact intermediate transfer sheet 50 and print paper 60 coming out of the rolling section between the heat roller 2 and press roller 3 are relieved of the external force which has curled them, and carried along a delivery guide 81.

The delivery guide 81 consists of a bent section 81*a* which curves to match with the curving of the transfer sheet 50 and paper 60 caused by the rolling section, and a slant section 81*b* where the transfer sheet 50 and paper 60 coming down from the bent section 8*a* are carried while being cooled by a cooling device 42. Consequently, cooled toner on the print paper 60 solidifies and adheres strongly to the paper 60. The cooling device 42 is of the blower type, and accordingly it also functions to carry the transfer sheet 50 and paper 60 to the delivery port by a blow of air.

The transfer sheet 50 and paper 60 arriving at the delivery port is separated from each other by a separating device (not shown) or by the user's hand, and the print paper 60 has a color picture fixed on it. The toner image transferred and fixed on the print paper 60 has the rendition of the smoothness of the surface of intermediate transfer sheet 50, and it highly polishes.

The heat roller 2 and press roller 3 having 80-mm outer diameter are made of aluminum bore cylinders coated with silicon rubber layers having 30-degree hardness and 0.5-mm and 3-mm thicknesses, respectively. Both rollers 2 and 3 incorporate halogen lamps for the heat sources 20 and 30, and have their pressing force adjusted to have a contact length of 7.5 mm, in which the heat roller 2 sinks into the general profile of press roller 3.

The image forming apparatus of the foregoing structure was operated to print images on sheets of ordinary paper (J-paper), thin paper (S-paper) and thick paper (Shiraoi-paper) at a carrying speed (transfer-fixing speed) of 160 mm/s thereby to assess the emergence of paper creases and uneven polish. Satisfactory print results without the emergence of paper creases or uneven polish were obtained.

What is claimed is:

1. An image forming method comprising the operational steps of:

forming a toner image on a toner image retaining medium of the sheet type;

bringing a recording medium of the sheet type in face-contact with said toner image retaining medium so that the toner image is caught therebetween;

heating and pressing said toner image retaining medium and recording medium in face-contact with each other, with the toner image being caught therebetween, the heating and pressing comprising a pressing member pressing the toner image retaining medium and recording medium against a heating member; and relieving of the heat and press and thereafter cooling said toner image retaining medium and recording medium in face-contact with each other, with the toner image being caught therebetween, so that the toner image is fixed on said recording medium;

wherein said toner image retaining medium, with the toner image being retained thereon, and said recording medium in face-contact with each other are heated and pressed in a curly state, and the curling direction of said toner image retaining medium and recording medium in face-contact with each other is reversed at least once before the end of said step of heat-pressing.

2. An image forming method comprising the operational steps of:

forming a toner image on a toner image retaining medium of the sheet type;

bringing a recording medium of the sheet type in face-contact with said toner image retaining medium so that the toner image is caught therebetween;

heating and pressing said toner image retaining medium and recording medium in face-contact with each other, with the toner image being caught therebetween, during which a pressing member presses the toner image retaining medium and recording medium against a heating member; and relieving of the heat and press and thereafter cooling said toner image retaining medium and recording medium in face-contact with each other, with the toner image being caught therebetween, so that the toner image is fixed on said recording medium;

wherein said toner image retaining medium, with the toner image being retained thereon, and the recording medium in face-contact with each other are heated and pressed while being kept in a flat state.

3. An image forming method comprising the operational steps of:

forming a toner image on a toner image retaining medium of the sheet type;

bringing a recording medium of the sheet type in face-contact with said toner image retaining medium so that the toner image is caught therebetween;

heating and pressing said toner image retaining medium and recording medium in face-contact with each other, with the toner image being caught therebetween; and relieving of the heat and press and thereafter cooling said toner image retaining medium and recording medium in face-contact with each other, with the toner image being caught therebetween, so that the toner image is fixed on said recording medium;

wherein said toner image retaining medium, with the toner image being retained thereon, and said recording medium in face-contact with each other are heated and pressed in a curly state, and said toner image retaining medium and recording medium are kept in the curly state at the time of heat-pressing after the relief of the heat-pressing until toner which has been fused by the heat-pressing cools down below a toner fusing temperature.

4. An image forming method comprising the operational steps of:

forming a toner image on a toner image retaining medium of the sheet type;

bringing a recording medium of the sheet type in face-contact with said toner image retaining medium so that the toner image is caught therebetween;

heating and pressing said toner image retaining medium and recording medium in face-contact with each other, with the toner image being caught therebetween, during which a pressing member presses the toner image retaining medium and recording medium against a heating member; and relieving of the heat and press and thereafter cooling said toner image retaining medium and recording medium in face-contact with each other, with the toner image being caught therebetween, so that the toner image is fixed on said recording medium;

wherein said toner image retaining medium and recording medium in face-contact with each other are relieved with an external force, which forces said face-contact mediums to curl, simultaneously with the relief of the heat-pressing.

5. An image forming apparatus for forming a fixed toner image on a recording medium comprising:

a toner image retaining medium of the sheet type which retains and brings a toner image formed thereon to a predetermined image transfer position;

toner image forming means which form the toner image on said toner image retaining medium;

recording medium carrying means which supply a recording medium of the sheet type by being timed so that said recording medium is brought in face-contact with said toner image retaining medium, with the toner image being caught therebetween; and heat-pressing means which heat and press said toner image retaining medium and recording medium in face-contact with each other, with the toner image being caught therebetween, at said image transfer position during the carriage in a curly state, and defines the carrying path of said face-contact mediums so that the curling direction of said face-contact mediums is reversed at least once before the end of said heat-pressing operation and in which the heat-pressing means comprises a pressing member that presses the toner image retaining medium and recording medium against a heating member.

6. The image forming apparatus according to claim 5, wherein said heat-pressing means include two rollers which press each other to form an arcuate rolling section where one roller sinks into the general profile of another (first) roller, with said toner image retaining medium being caught therein, and a medium path defining member which defines the carrying path of said toner image retaining medium so that said toner image medium is carried along the profile of said first roller before said toner image retaining medium reaches the rolling section, and wherein said recording medium carrying means supply a sheet of recording medium so that said recording medium is caught between said first roller and said toner image retaining medium running along the profile of said first roller.

7. An image forming apparatus for forming a fixed toner image on a recording medium comprising:

a toner image retaining medium of the sheet type which retains and brings a toner image formed thereon to a predetermined image transfer position;

toner image forming means which form the toner image on said toner image retaining medium;

recording medium carrying means which supply to said image transfer position a recording medium of the sheet type by being timed so that said recording medium is brought in face-contact with said toner image retaining medium, with the toner image being caught therebetween; and heat-pressing means which heat and press said toner image retaining medium and recording medium in face-contact with each other, with the toner image being caught therebetween, at said image transfer position, while defining the carrying path of said face-contact mediums so that said face-contact mediums are kept in a flat state, the heat-pressing means comprising a pressing member that presses the toner image retaining medium and recording medium against a heating member.

8. The image forming apparatus according to claim 7, wherein said heat-pressing means include two rollers of the same material and same diameter, said rollers pressing each other, with said toner image retaining medium and recording medium being caught therebetween.

9. The image forming apparatus according to claim 7, wherein said heat-pressing means include two members, said members pressing each other, with said toner image retaining medium and recording medium being caught between confronting planar surfaces thereof.

10. An image forming apparatus for forming a fixed toner image on a recording medium comprising:

a toner image retaining medium of the sheet type which retains and brings a toner image formed thereon to a predetermined image transfer position;

toner image forming means which form the toner image on said toner image retaining medium;

recording medium carrying means which supply a recording medium of the sheet type by being timed so that said recording medium is brought in face-contact with said toner image retaining medium, with the toner image being caught therebetween;

heat-pressing means which heat and press said toner image retaining medium and recording medium in face-contact with each other, with the toner image being caught therebetween, at the image transfer position during the carriage in a curly state; and carrying path defining means which define the carrying path of said toner image retaining medium and recording medium in face-contact with each other so that said face-contact mediums remain in the curly state of the time of heat-pressing during the carriage after the relief of the heat-pressing by said heat-pressing means until toner which has been fused by the heat-pressing cools down below a toner fusing temperature.

11. An image forming apparatus forming a fixed toner image on a recording medium comprising:

a toner image retaining medium of the sheet type which retains and brings a toner image formed thereon to a predetermined image transfer position;

toner image forming means which form the toner image on said toner image retaining medium;

recording medium carrying means which supply a recording medium of the sheet type by being timed so that said recording medium is brought in face-contact with said toner image retaining medium, with the toner image being caught therebetween; and heat-pressing means which heat and press said toner image retaining medium and recording medium in face-contact with each other, with the toner image being caught therebetween, at said image transfer position during the carriage in a curly state, and relieves said face-contact of an external force, which forces said face-contact mediums to curl, simultaneously with the relief of the heat-pressing and in which the heat-pressing means is a pressing member that presses the toner image retaining medium and recording medium against a heating member.

* * * * *